United States Patent [19]

Logue

[11] Patent Number: 4,558,795

[45] Date of Patent: Dec. 17, 1985

[54] BOTTLE STOPPERS OR CLOSURES

[76] Inventor: Adrian R. J. Logue, 23 Cherryvalley, Belfast BT5 6PF, Northern Ireland

[21] Appl. No.: 485,221

[22] Filed: Apr. 13, 1983

[51] Int. Cl.[4] ..... B65D 51/16

[52] U.S. Cl. ..... 215/260; 215/315

[58] Field of Search ..... 215/260, 315

[56] References Cited

U.S. PATENT DOCUMENTS

| | | | |
|---|---|---|---|
| 1,363,804 | 12/1920 | Mohn | 215/260 |
| 2,545,233 | 3/1951 | Kaufman | 215/260 X |
| 3,243,071 | 3/1966 | Kimmel | 215/315 X |
| 4,181,233 | 1/1980 | Gouveia | 215/260 X |

FOREIGN PATENT DOCUMENTS

| | | | |
|---|---|---|---|
| 76674 | 4/1983 | European Pat. Off. | 215/315 |
| 6735 | 3/1879 | Fed. Rep. of Germany . | |
| 777287 | 11/1934 | France | 215/260 |
| 793388 | 11/1935 | France . | |
| 92084 | 12/1921 | Switzerland . | |
| 14491 | of 1915 | United Kingdom | 215/315 |

*Primary Examiner*—Donald F. Norton

*Attorney, Agent, or Firm*—Mason, Fenwick & Lawrence

[57] ABSTRACT

A bottle stopper has a head and stem having therethrough a continuous passage wherein is located a valve comprising a restriction in the head of passage and affording at the stem-remote side thereof a seat for a resiliently-loaded stop.

The valve is resiliently urged into a closed position but yieldable to open when pressure in the bottle to which it is fitted exceeds the resilient pressure. The head and stem are engageable, respectively, over the mouth and against the internal surface of the neck of a bottle when fitted to a bottle.

3 Claims, 10 Drawing Figures

11
12
13
10
IV
25
14
15
16
26
12
13
12
13
26A
IV 10
25
16
25

24
23
24
24

24
23
24

BOTTLE STOPPERS OR CLOSURES

This invention relates to a bottle stopper or closure for use in 'home' wine-making.

A disadvantage of known bottle stoppers or closures is that they do not enable a 'home' wine producer to make a sparkling sweet wine, although with a lot of effort and attention, it is possible that a sparkling dry wine can be made. Also, whereas it is essential in sparkling wine-making that the pressure in the individual bottles can be guaranteed to obtain a desired sparkling wine, heretofore to obtain the desired pressure has simply been a 'hit or miss' selection by the producer. Problems are also encountered in disgorging yeast deposit from the bottle.

An object of the present invention is to obviate or mitigate these disadvantages.

According to the present invention, a bottle stopper or closure has a head and a stem engageable, respectively, over the mouth and against the internal surface of the neck of a bottle when fitted to a bottle, the head and stem having therethrough a continuous passage wherein is a valve resiliently urged into the closed position but yieldable to open when pressure in the bottle exceeds the resilient pressure.

Preferably, the valve comprises a restriction in the head of the passage and affording at the stem-remote side thereof a seat for a resiliently-loaded stop.

Preferably also, the passage from stem to head has a frusto-conical portion feeding into the restriction beyond which is an open-ended chamber portion in which latter portion the resiliently-loaded stop is located acting against the seat provided at the outlet of said restriction.

Preferably also, a pull cord is provided at the outer end of the stop to enable the valve to be opened by manually pulling the stop against its resilient-loading for the purpose of disgorging to remove yeast deposit on the walls of the frusto-conical portion.

An embodment of the present invention will now be described, by way of example, with reference to the accompanying drawings, in which.

Figure 1A:
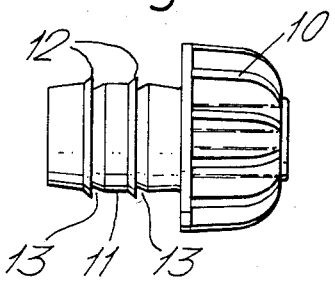
FIGS. 1A and 1B are respectively a side view and a view in the direction of a head of the stopper of a bottle stopper or closure according to the present invention.
Figure 1B:
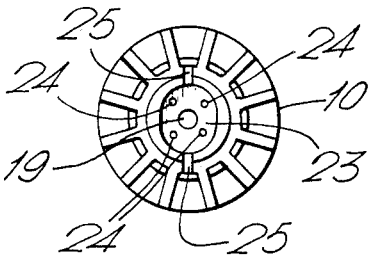
Figure 2:
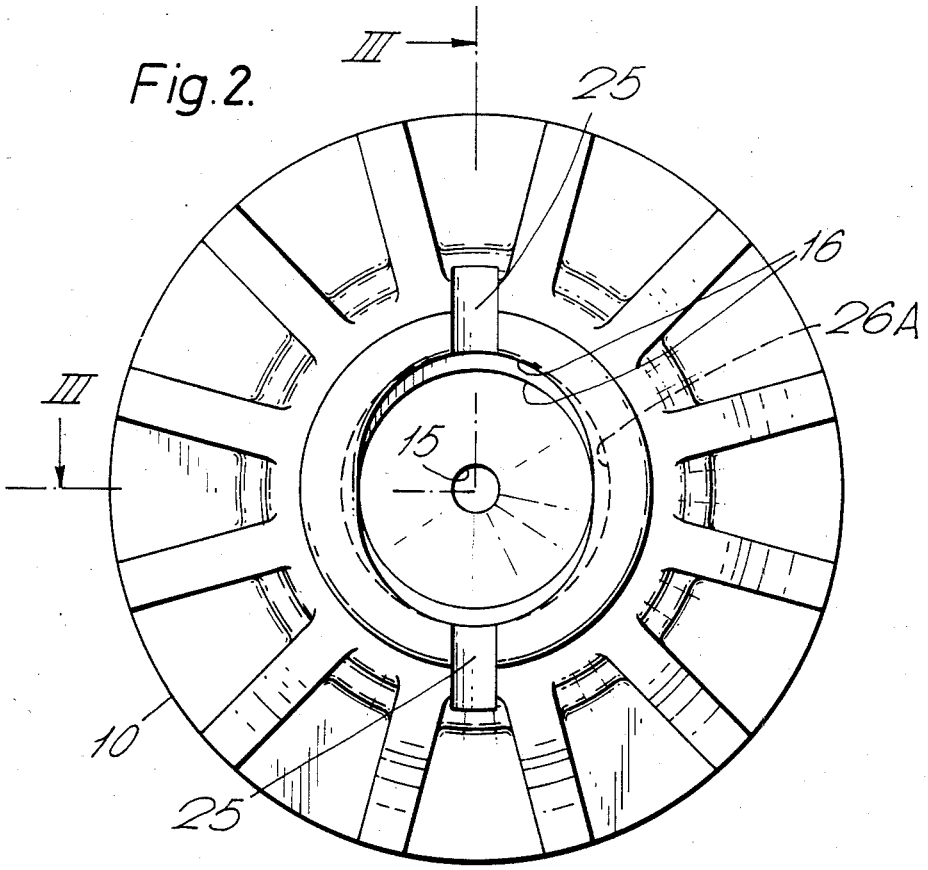
FIG. 2 is a similar view to FIG. 1B of the stopper to a larger scale than FIG. 1B with a resilient valve mechanism omitted.
Figure 3:
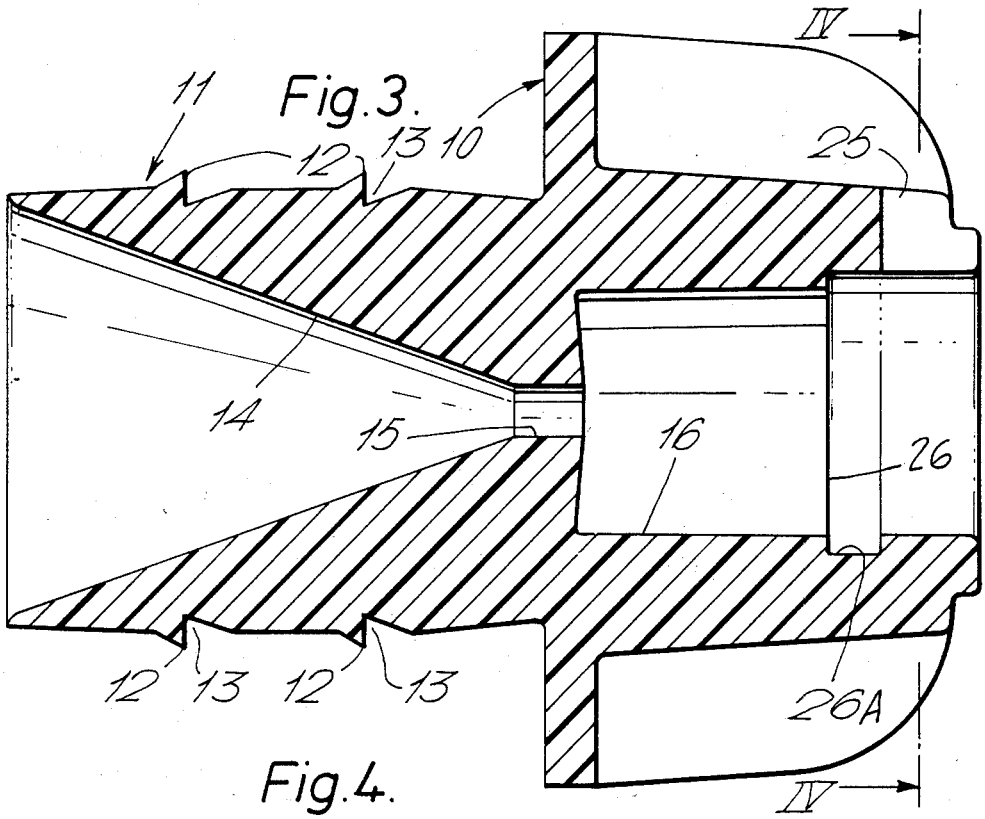
FIG. 3 is a section on the line III—III of FIG. 2.
Figure 4:
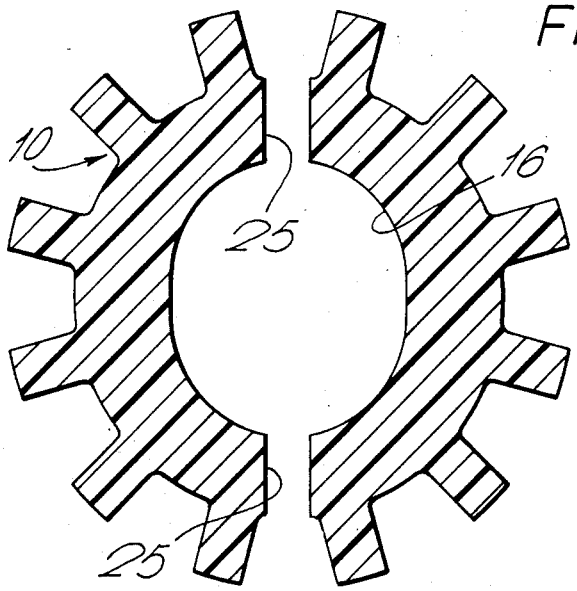
FIG. 4 is a section on the line IV—IV of FIG. 3.
Figure 5A:
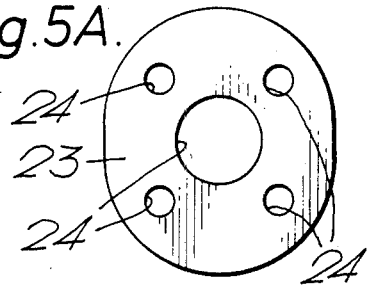
FIGS. 5A and 5B are respectively a plan view and a side view of a retainer.
Figure 5B:
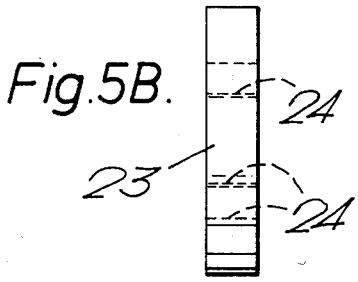
Figure 7:
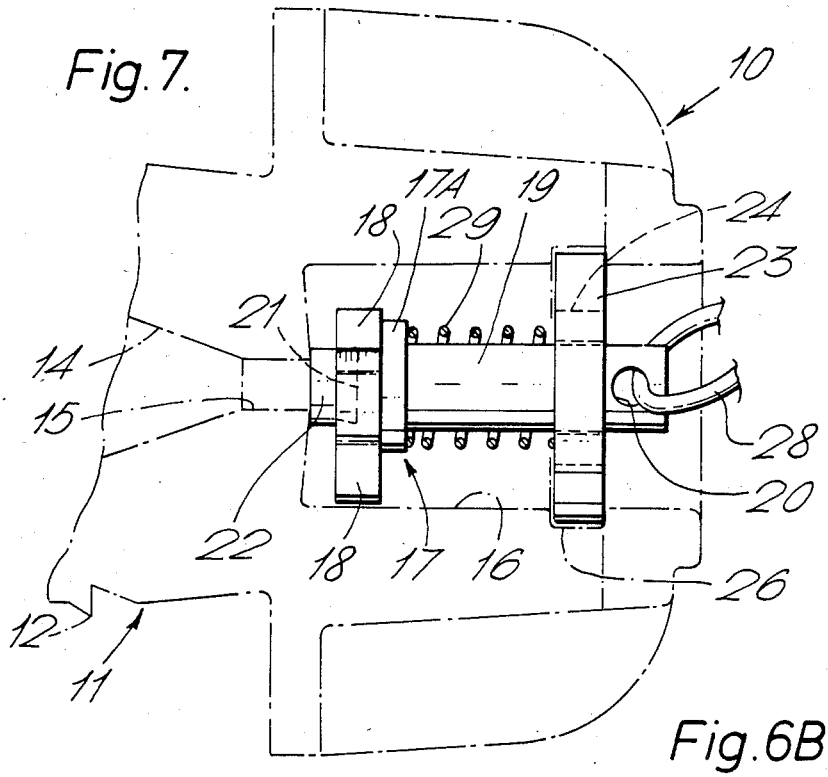
FIG. 7 is a side view of the valve mechanism assembled in the head of the stopper shown in broken line.
Figure 6B:
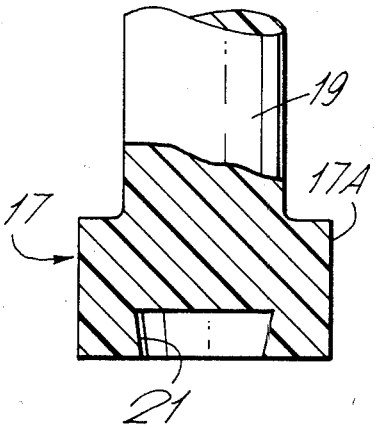
FIGS. 6A and 6B are respectively a plan view of a stop, and a section on the line VI—VI of FIG. 6A.
Figure 6A:
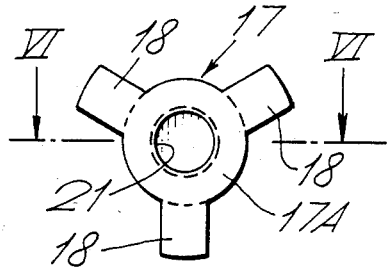

Referring to the drawings, a bottle stopper or closure has a moulded body shaped to provide a head 10 and a stem 11 engageable respectively, over the mouth and against the internal surface of the neck of a bottle when fitted to a bottle. The stem 11 has means on its outer surface in the form of circumferential ribs 12 and grooves spaced along its length to engage against the internal surface of the neck of the bottle when inserted thereinto to hold said stopper in said neck. A continuous passage is provided through said stem 11 and head 10. The passage from stem 11 to head 10 has a series of portions of different configurations, namely a frusto-conical portion 14, a restriction 15, and an open-ended chamber portion 16. A valve is provided in line with the passage and comprises a stop 17 resiliently-loaded against a seat provided at the outlet of the restriction 15 into the chamber portion 16. The stop 17 has a disc 17A provided with three equispaced radial arms 18 projecting therefrom. A spindle 19 extends axially from one side of the disc and has a diametrical bore 20 at its outer end whose axis is at right angles to the axis of the spindle 19, and in the opposite side of the disc, a circular recess 21 is provided to seat a replaceable seal 22 of natural or synthetic rubber or other suitable material. A retaining cap 23 of ovoid shape has apertures 24 therethrough whose axes are parallel to the perpendicular axis through the centre of the cap 23. A groove 26 of rectangular channel shape as shown in FIGS. 3 and 7 is provided around the inside wall of chamber portion 16, the inner web **26*a* of which groove 26 lying on a path traced out by a diameter slightly greater than the greater length of the ovoid retainer cap 23, and the chamber portion 16 is ovoid, as shown in FIGS. 3 and 4 between its outer end and the groove being of slightly greater dimensional area than the ovoid cap 23 whereby the retainer cap 23, when in areal registry with the chamber portion 16, can be inserted into the groove by a special tool through said chamber portion 16 and into the groove, and in a continuing movement, against the influence of resilient biasing of the stop 17, rotating the cap through 90 degrees to the head and out of areal registry with the chamber, the ovoid cap 23 then being retained in its position by its bearing against a stem-remote wall of the groove 26. This captive position also holds the cap 23 against axial movement. The spindle 19 projects through a central aperture 24 in said cap 23 and a pull cord 28 is threaded through the bore 20, channels 25 in the head 10 as shown being provided to assist in threading the cord 28 through the bore 20. The resilient biasing of the stop 17 is in the form of a helical spring 29 of non-corrodible material, such as stainless steel, and is located in the chamber portion 16 in the space between the top surface of the disc 17A and the underneath surface of the retaining cap 23 to abut against pertaining surfaces of the cap 23 and disc 17A and also to bias the seal 22 against its seat at the outlet of the restriction 15. The retaining cap 23, stop 17, stem 11 and head 10 are all of plastic material, and the head 10 and stem 11** are integrally formed in the moulded body.

In use, a bottle stopper above-described is inserted into a neck of a bottle full of wine mixture to be left to ferment while the bottle is in an upright position. The stopper is wired to the neck of the bottle. As fermentation occurs if pressure in the wine bottle becomes greater than the pressure of the resilient-loading, then the valve opens by movement of stop 17 against its seat to allow escape of gas and then when the pressure in the bottle decreases below that of the biasing, the biasing urges the stop 17 to close the valve again.

When the wine is known to be finished fermentation, the bottle is inverted and left until the yeast has collected inside the stopper and removed by manually pulling the stop 17 via cord 28 against the biasing and allowing it to disgorge itself from said bottle and through chamber portion 16 and the apertures 24 to waste. Several pulls may be necessary for all the yeast to be forcibly expelled or disgorged. The stopper is thereafter removed and a known cork or equivalent stopper fitted. The stopper above-described is then washed and is ready for re-use.

I claim:

1. A bottle stopper having a head and a stem engageable respectively, over the mouth and against the internal surface of the neck of a bottle when fitted to a bottle wherein the head and the stem have a continuous passage therethrough, the passage having from stem to head, a frusto conical portion feeding into a restriction beyond which is an open-ended chamber, a valve located in said passage and resiliently urged into a closed position to close off said passage but yieldable to open when pressure in the bottle exceeds the resilient pressure, the valve comprising a resiliently-loaded stop, a seat for the resiliently-loaded stop being afforded at the stem-remote side of the restriction, the stop being located in the chamber acting against the seat provided at the outlet of said restriction, the stop having a disc from one side of which axially extends a spindle and in opposite side a recess is provided to locate a seal for urging against the seat, and a retaining cap having an axial aperture through which projects the top of the spindle, the cap being secured in a groove in the wall of the chamber with a resilient-biasing for the stop being located between the disc and cap.

2. A bottle stopper according to claim 1, wherein the shape of the chamber is ovoid between its outer end and the groove and the cap is of ovoid shape, the groove in the chamber wall being a rectangular channel whose inner web lies on a path traced out by a diameter slightly greater than the greater length of the cap, the cap being secured by being located in the groove and rotated through 90 degrees to engage against a stem remote wall of the groove.

3. A bottle stopper according to claim 1, wherein a pull cord is provided at the outer end of the stop to enable the valve to be opened by manually pulling the spindle against its resilient-biasing for disgorging to remove yeast deposit on the walls of the frusto-conical portion.

* * * * *